US005599171A

United States Patent [19]

Horwitz

[11] Patent Number: 5,599,171

[45] Date of Patent: Feb. 4, 1997

[54] ROTARY, SELF-PRIMING, LIQUIP PUMP, AND AN IMPELLERS AND SHAFT ASSEMBLY THEREFOR, AND A FLEXIBLE-IMPELLER PUMP ASSEMBLY

[75] Inventor: Robert P. Horwitz, Orange, Calif.

[73] Assignee: ITT Fluid Technology Corporation, Midland Park, N.J.

[21] Appl. No.: 440,793

[22] Filed: May 15, 1995

[51] Int. Cl.[6] ..... F04B 23/08

[52] U.S. Cl. ..... 417/199.2; 417/203; 415/143

[58] Field of Search ..... 417/199.1, 199.2, 417/201, 203; 415/141, 143

[56] References Cited

U.S. PATENT DOCUMENTS

| | | | |
|---|---|---|---|
| 2,899,902 | 8/1959 | Bandli et al. | 415/141 |
| 3,082,694 | 3/1963 | Brkich | 417/199.2 |
| 3,518,028 | 6/1970 | Minick | 417/199.2 |
| 4,256,436 | 3/1981 | Fandrey et al. | 415/143 |
| 4,392,779 | 7/1983 | Bloemers et al. | 415/141 |
| 4,624,627 | 11/1986 | Tunks | 417/199.2 |

FOREIGN PATENT DOCUMENTS

| | | | |
|---|---|---|---|
| 11818 | of 1910 | United Kingdom | 418/209 |

*Primary Examiner*—Charles G. Freay
*Attorney, Agent, or Firm*—M. J. Lombardi

[57] ABSTRACT

A pump housing has a plurality of chambers formed therein, and a shaft journaled within, the shaft having impellers keyed thereto. Each chamber has one of the impellers disposed therein. One of the impellers is the primary liquid-working element, and has rigid vanes. The vanes are generously spaced apart from the enclosing chamber walls. A second impeller has flexible vanes, and serves as a priming element; it has an intimate fit in its chamber and cooperates with an outlet flapper valve to create a negative pressure in the liquid inlet. Consequently, the pump can self-prime even when absolutely dry.

20 Claims, 8 Drawing Sheets

ROTARY, SELF-PRIMING, LIQUIP PUMP, AND AN IMPELLERS AND SHAFT ASSEMBLY THEREFOR, AND A FLEXIBLE-IMPELLER PUMP ASSEMBLY

BACKGROUND OF THE INVENTION

This invention pertains to rotary liquid pumps, such as vortex-type cooling pumps used, for example, with marine diesel engines, and to an impellers and shaft assembly for Such pumps as well as to flexible-impeller pump assemblies.

Existing rotary, self-priming, liquid pumps, having flexible impellers, which self-prime when dry, are capable of pumping up to one hundred and twenty-five gallons of liquid per minute, and such are suitable for use with marine diesel engines, or the like, having up to about twelve hundred horsepower. At engine speeds of from approximately twenty-one hundred to twenty-five hundred revolutions per minute, larger flexible impeller pumps will cavitate under such circumstances. There has been a long standing need for a rotary, self-priming, liquid pump having a capability for handling flow rates up to about four hundred gallons of liquid a minute for use in cooling engines of up to about twenty-five hundred horsepower. Too, then, there has been a collateral need for a novel impellers and shaft assembly for the aforesaid, needed, greater-capability pump, and an improved flexible-impeller pump assembly for pump priming and other uses.

In the prior art there are regenerative-turbine and/or side-channel, water ring pumps which comprise the equipment presently available for marine diesel cooling. However, such are very inefficient, the efficiency thereof being in the order of twenty-five percent. These prior art pumps cannot self-prime when absolutely dry, and must have impeller clearances of approximately 0.006 to 0.010 inch in order to insure that they will operate at all. Such fine clearances make these pumps difficult and expensive to manufacture, and they have a low tolerance for sand and debris. More, the known pumps have a high, radial, hydraulic loading on the impellers, due to the differential pressure thereacross; this can occasion broken shafts, seal leakages, and bearing failure.

SUMMARY OF THE INVENTION

In view of the just cited problems with which the known liquid pumps are met, and the need for a pump with greater capability, it is an object of this invention to disclose a new, improved rotary, liquid pump which is self-priming when dry, and which is suitable, especially, with marine diesel engines, and a novel impellers and shaft assembly therefor.

Particularly, it is an object of this invention to set forth a rotary, liquid pump comprising a housing; a shaft journaled in said housing; a pair of impellers mounted on said shaft, in spaced apart disposition, for rotation in common with said shaft; means for admitting liquid into said housing; and means for discharging impelled liquid from said housing; wherein one of said impellers has rigid vanes; and the other of said impellers has flexible vanes.

Also it is an object of this invention to disclose an impellers and shaft assembly, for use in a rotary, liquid pump, comprising a shaft; and a pair of impellers mounted on said shaft for common rotation therewith; wherein one of said impellers has flexible vanes.

Another object of this invention is to set forth a flexible-impeller pump assembly comprising a ring, having an inner circumferential surface; an impeller, having flexible fingers, journaled in said ring on a given axis; walls (a) replaceably fixed to either sides of said ring, and (b) cooperating with said surface to define a pumping chamber within said ring and between said walls; wherein said surface is uninterruptedly continuous; one of said walls has inlet porting formed therein for admitting fluid, axially, into said chamber; and another of said walls has outlet porting formed therein for discharging fluid, axially, from said chamber.

Further objects of this invention, as well as the novel features thereof, will become apparent by reference to the following description, taken in conjunction with the accompanying figures.

DETAILED DESCRIPTION OF THE PREFERRED EMBODIMENTS

Figure 1:
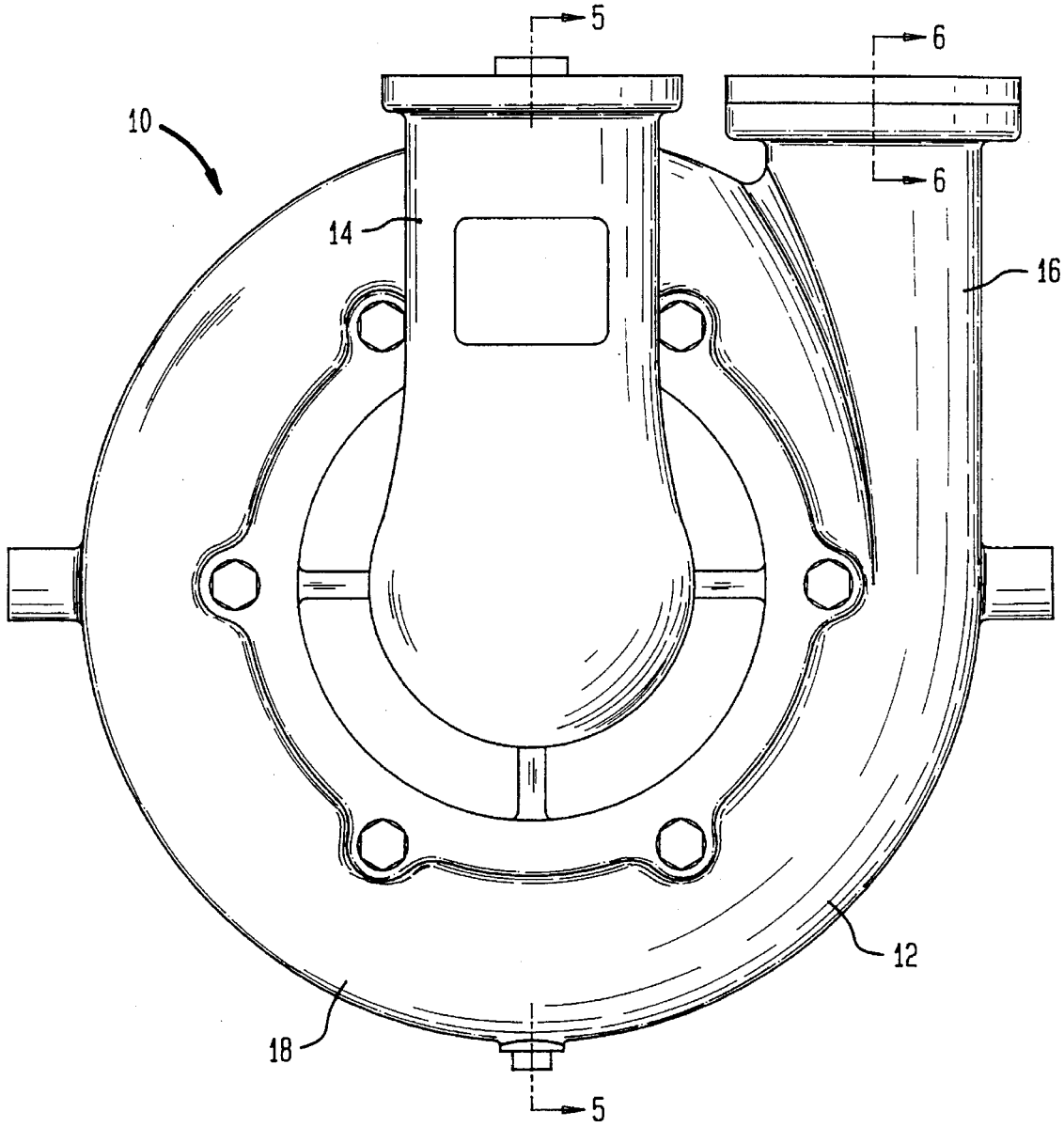
FIG. 1 is a front, elevational view of the novel pump, according to an embodiment thereof.
Figure 2:
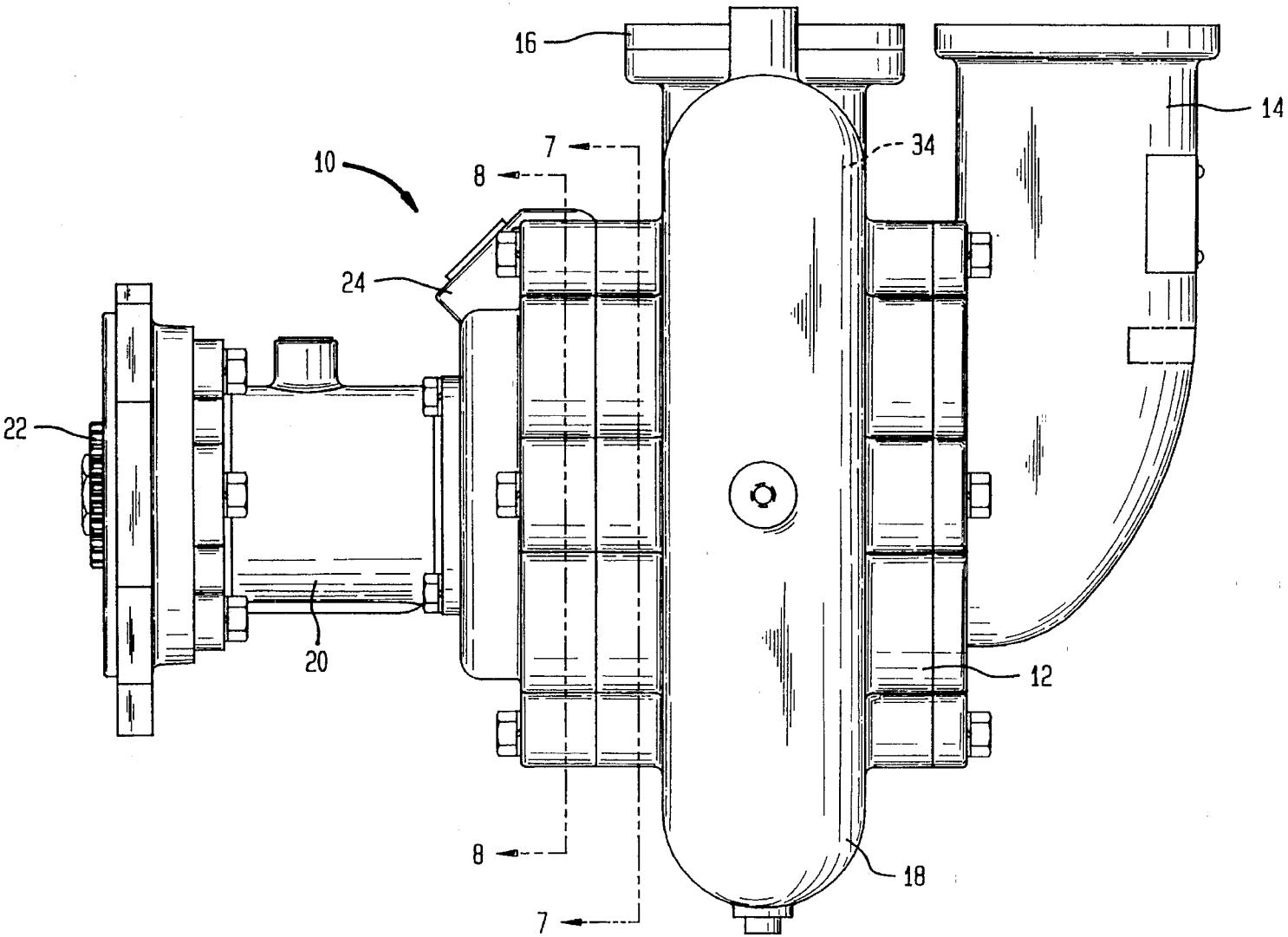
FIG. 2 is a side elevational view thereof.
Figure 3:
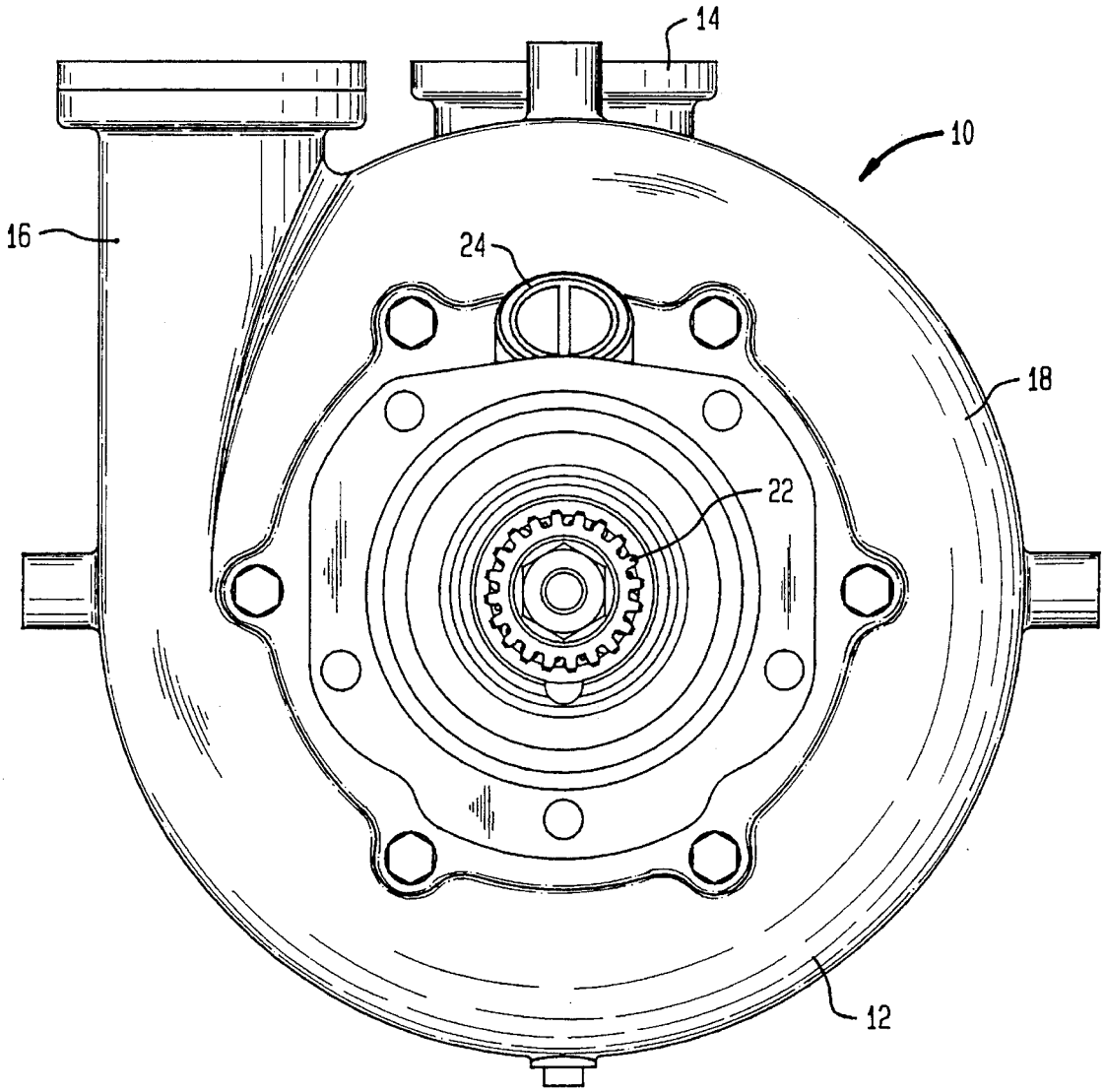
FIG. 3 is a rear elevational view thereof.
Figure 4:
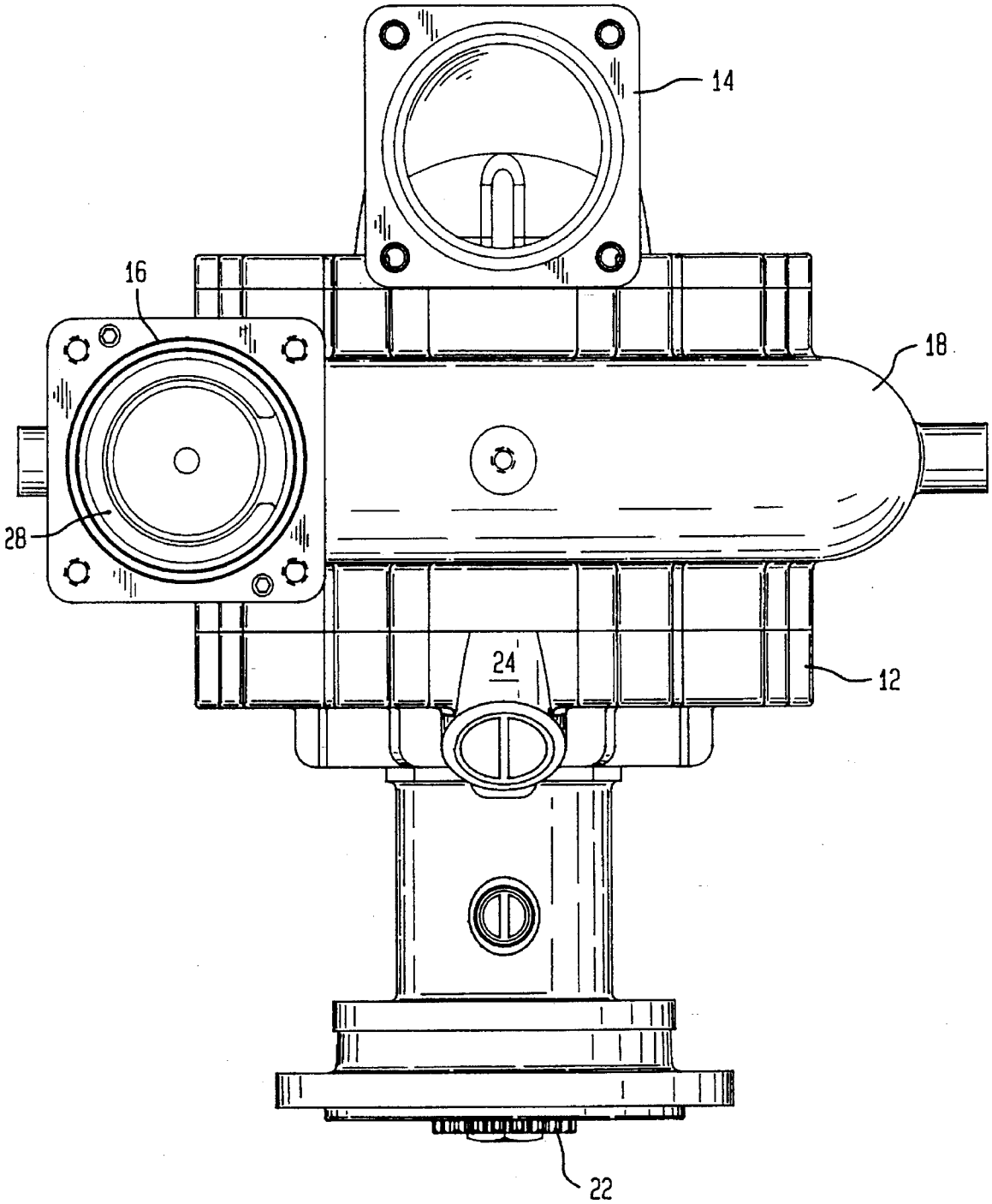
FIG. 4 is a top or plan view thereof, taken from FIG. 3.

As shown in FIGS. 1 through 4, the novel, rotary, liquid pump 10 comprises a housing 12. The housing 12 has an inlet conduit 14 bolted thereto, and an outlet conduit 16 extending therefrom, the same being integral with the main body 18 of the housing 12. A distance piece 20 is fastened to the housing 12 and, at the outermost end thereof, bares an input gear 22. The gear 22 is disposed for engagement thereof with a prime mover (not shown). The housing 12 further has an angled, short cylinder 24 extending therefrom, the same comprising a second outlet conduit. Installed in the outermost end of the outlet 16 is a check valve 28 of the flapper type.

Figure 5:
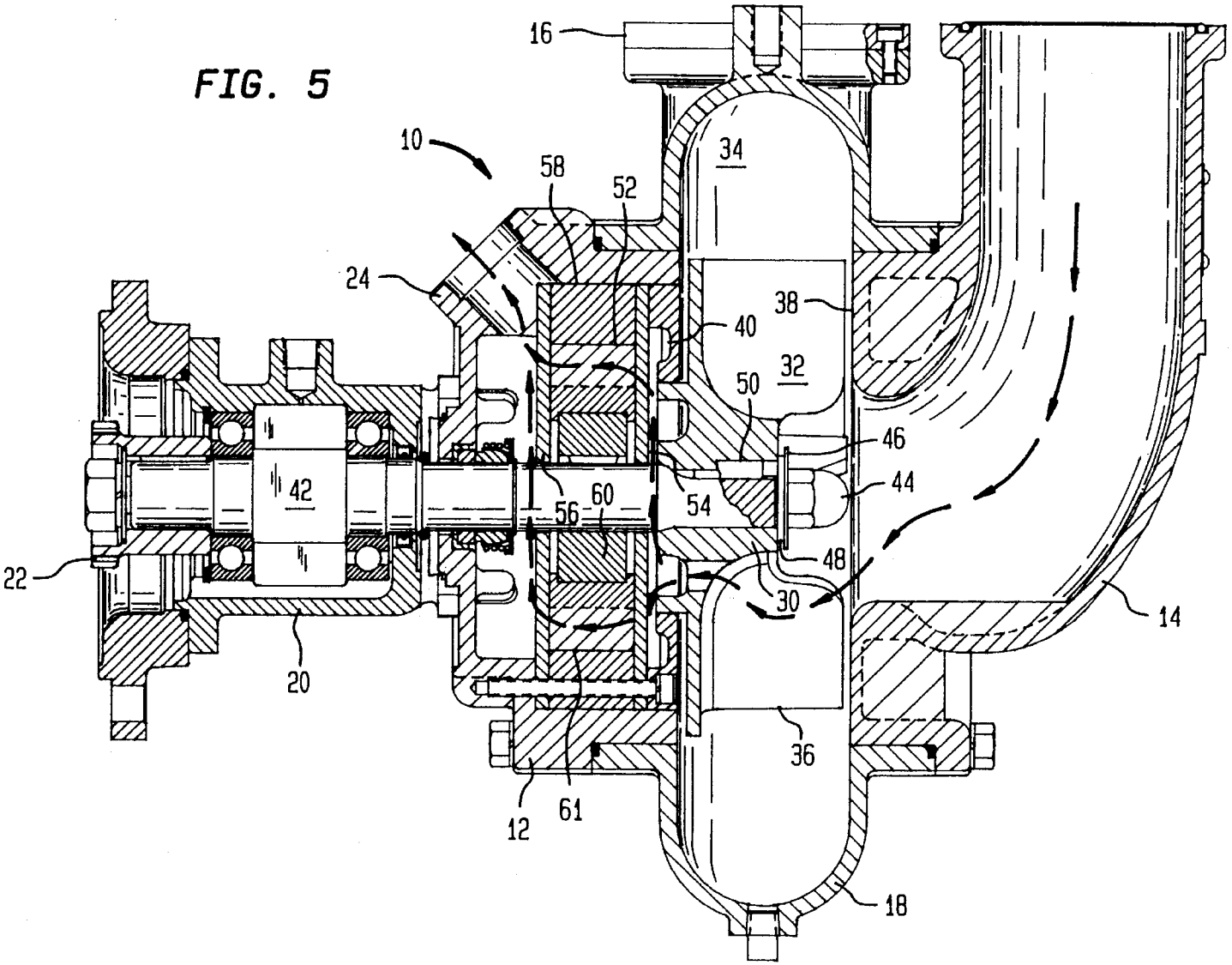
FIG. 5 is a cross-sectional view thereof, taken along section 5—5 of FIG. 1.

FIG. 5 shows the inner structures of the pump 10. Therein it can be seen that the inlet conduit 14 opens onto the hub 30 of a paddle-wheel-type impeller 32. The impeller 32, in this embodiment thereof, has a diameter of approximately six inches, and it is disposed for rotation within a liquid-working chamber 34 which has a diameter of approximately twelve inches. The impeller 32 and the vanes 36 thereof are rigid; the vanes 36 are straight, and terminated with flat ends. Chamber 34 has parallel, confronting walls 38 and 40, and the lateral edges of the vanes 36 are spaced apart, from the walls, approximately one-eighth of an inch. Impeller hub 30 is engaged with a rotary shaft 42, the terminal end of the shaft being threaded and has a nut 44, torqued thereon, which holds a washer 46 and a lock washer 48 fast against the hub 30. The shaft 42 and hub 30 have keyways formed therein which receive a key 50 for mating the impeller 32 with the shaft 42 for common rotation therewith.

Inboard of the chamber 34, the housing 12 has a second chamber 52. Chamber 52 is formed by a pair of circular plates 54 and 56 which are set apart, in parallelism, by an intervening ring 58. A second impeller 60 is confined within chamber 52, and keyingly engaged with the shaft 42 thereat. Impeller 60 has flexible (i.e., rubber) vanes 61, and the impeller width and diameter is such as to give it an intimate fit within the chamber 52; it is rotatable therein with a fine clearance relative to the walls and periphery of chamber 52. The impeller 32 is the main pumping element in the pump, whereas impeller 60 is a priming impeller.

Figure 8:
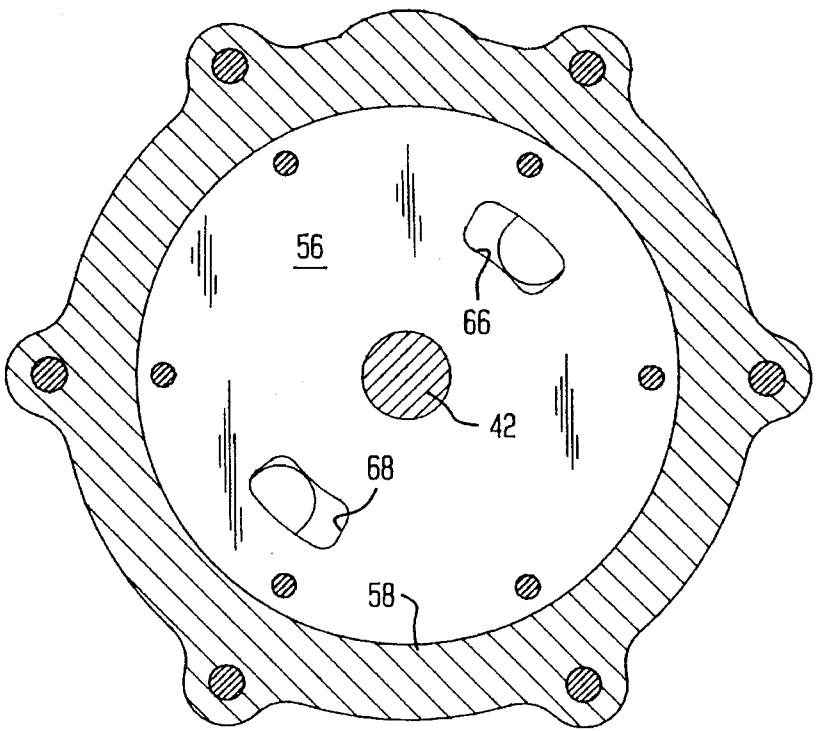
FIG. 8 is a cross-sectional view, taken along section 8—8 of FIG. 2.
Figure 7:
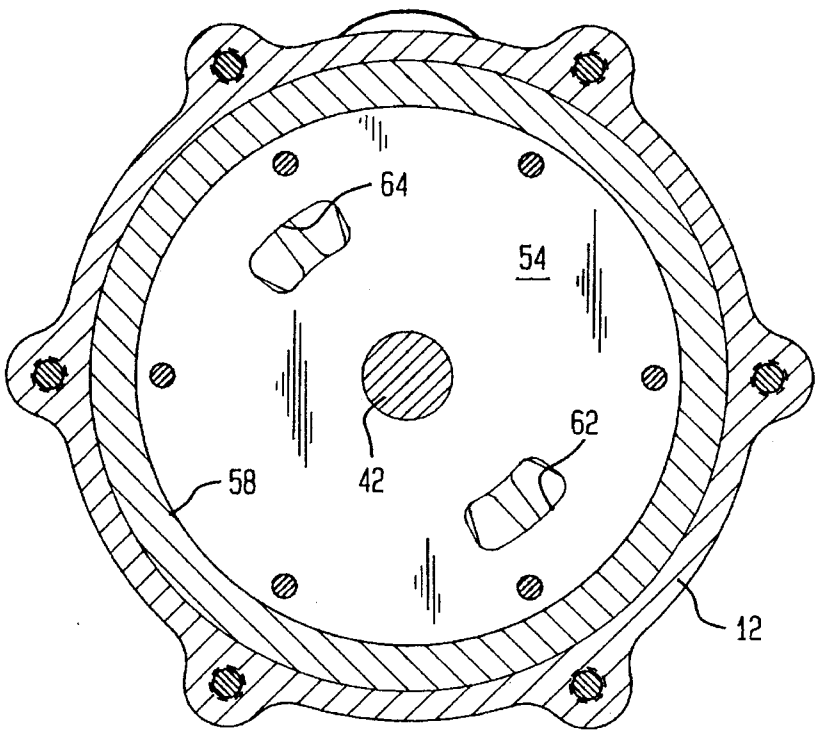
FIG. 7 is a cross-sectional view, taken along section 7—7 of FIG. 2.
Figure 10:
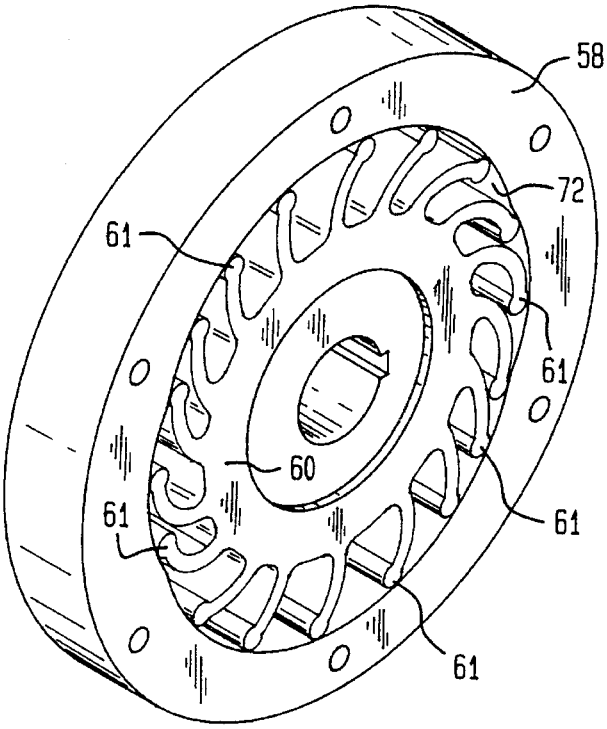
FIG. 10 is another perspective view of the flexible-impeller pump assembly with the side walls thereof removed to show the flexible-fingered impeller within the encompassing ring.

Impeller 60 is double-acting. The plates 54 and 56, as shown in FIGS. 7 and 8, have pairs of ports formed therein. Ports 62 and 64 of plate 54 constitute liquid inlets for the priming impeller 60, whereas the ports 66 and 68, of plate 56 constitute liquid outlets for the priming impeller 60. With each revolution thereof, the priming impeller 60 vents twice via the cylinder 24. Consequently, the priming impeller 60 is inherently balanced.

Figure 6:
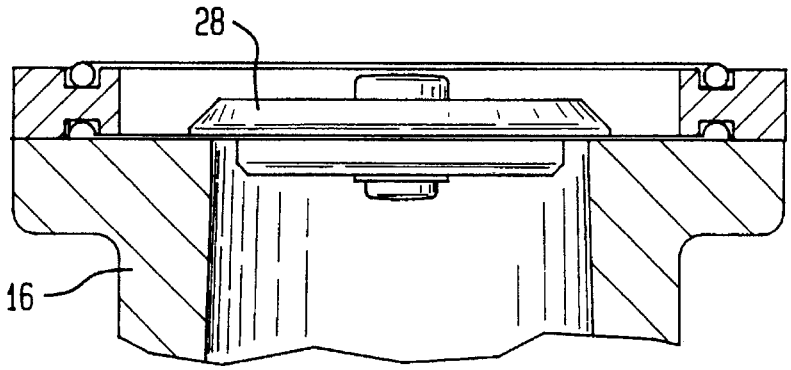
FIG. 6 is a fragmentary cross-sectional view, taken along section 6—6 of FIG. 1.
Figure 9:
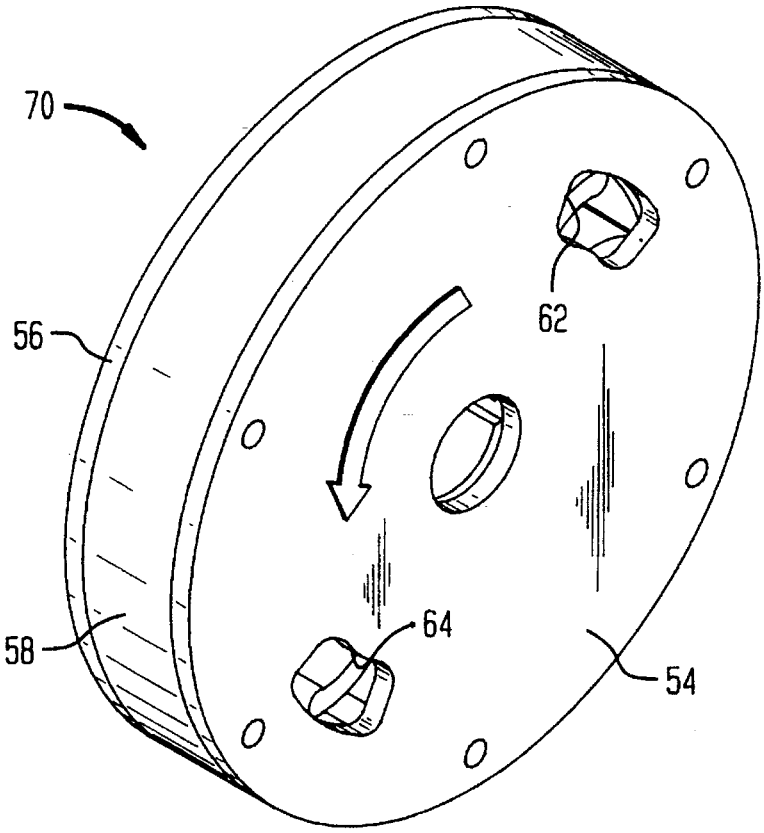
FIG. 9 is a perspective depiction of the novel flexible-impeller pump assembly which, by way of example, is incorporated in the subject, rotary, liquid pump.

With rotation of the shaft 42, on start-up, the impeller 60 primes even under dry (non-liquid) conditions. The flapper valve 28, shown in more detail in FIG. 6, cooperates with the impeller 60 to create a vacuum pressure in the inlet conduit 14. The impeller 60 ingests air, along the arrowed pathway shown in FIG. 5, until the vacuum pressure proceeds to draw liquid. When thus primed, the pump 10 expels liquid through the priming impeller discharge conduit embodied by the cylinder 24 and through the outlet conduit 16. Discharge pressure is generated by a spinning vortex in the constant velocity chamber 34.

The pump 10, shown herein to be of the vortex type in this embodiment of the invention is capable of flow rates up to about four hundred gallons of liquid a minute and able to provide cooling of engines of up to approximately 2500 horsepower. It is inordinately efficient; even with the parasitical load of the priming impeller 60, it operates at an efficiency range of approximately fifty to sixty percent. As noted, the pump 10, having the flexible-vane priming impeller 60 will self-prime even when the environment in which it commences to operate is absolutely dry. The paddle-wheel type, primary impeller 32 is not encumbered with close clearances in its chamber 34, accordingly it is not notably subject to wear; it can handle sand and debris exceedingly well. Too, the priming impeller 60, for having flexible vanes 61, can deal well with sand and other detritus. Radial loading of the impeller 32 is essentially zero; the constant velocity vortex generated about the periphery of the impeller 32 means that the pressure is also equal thereabout. Radial loading of the priming impeller 60 is also essentially zero because of its radial symmetry. Pump 10, then, promises long life in heavy duty for the seals and bearings thereof, and minimum replacements, over time, of the impellers 32 and 60.

In that the priming portion of the pump 10, comprising the impeller 60 rotary within the second chamber 52, and having flexible vanes 61, is double-acting (i.e., producing two pumping cycles per revolution), it effectively doubles the flow rate for a given impeller size and, as noted, eliminates radial thrust since all radial forces are balanced. Ordinarily, the priming portion of the pump 10 would cause a sacrifice in pressure capability but, with this embodiment of the invention, discharge pressure generation for the priming portion is not a requirement. Its discharge is simply routed overboard or to the exhaust system so that back pressure is minimal.

Prior art, flexible impeller pumps have inlet and discharge ports which are disposed radially of the impeller. In the instant invention, the inlet ports 62 and 64 in plate 54, and outlet ports 66 and 68 in plate 56 are axially disposed, and provide for an axial flow path through the priming portion of the pump 10. This arrangement allows for a continuous cam ring 58; the vanes 61 do not have to pass over any discontinuity in the ring 58. As a consequence, impeller life, and vane life are extended significantly.

The pump-priming portion of the pump 10, the same comprising the ring 58, impeller 60 with its flexible vanes or fingers 61, and the ported plates 54 and 56, constitutes a novel priming pump 70 in and of itself, for incorporation with a rotary, liquid pump 10, as disclosed herein, or for other, like applications. As a unit, mountable, keyingly, onto a driven rotary shaft, it is independently usable. As priorly noted, this priming pump 70 has an enclosing ring 58 which mounts plates 54 and 56 to either side thereof. The ring 58 has an inner circumferential surface 72 which is uninterruptedly continuous. The plates 54 and 56 cooperate with the ring 58 to define a pumping chamber 52 therewithin. Pump 70 has no radial ports; the inlet ports 62 and 64, as well as the outlet ports 66 and 68 produce an axial flow path through the pump 70. Ports 62 and 64, in plate 54 are equally spaced apart, i.e., one hundred and eighty degrees of arc apart, with reference to the rotary axis 74 of the pump 70, and the ports 66 and 68 are also similarly spaced apart. Too, the ports 62 and 64 are spaced apart from ports 66 and 68 ninety degrees of arc. With a reference to radial dispositions, inlet ports 62 and 64 are located at approximately forty-five and two hundred and twenty-five degrees of arc, and ports 66 and 68 at approximately three hundred and fifteen, and one hundred and thirty-five degrees of arc, from a vertical reference point 76 constituted by a bolt hole 78. Such positionings cooperate with the inner surface 72 of the pump 70 to derive the most efficient performance of the pump.

Figure 11:
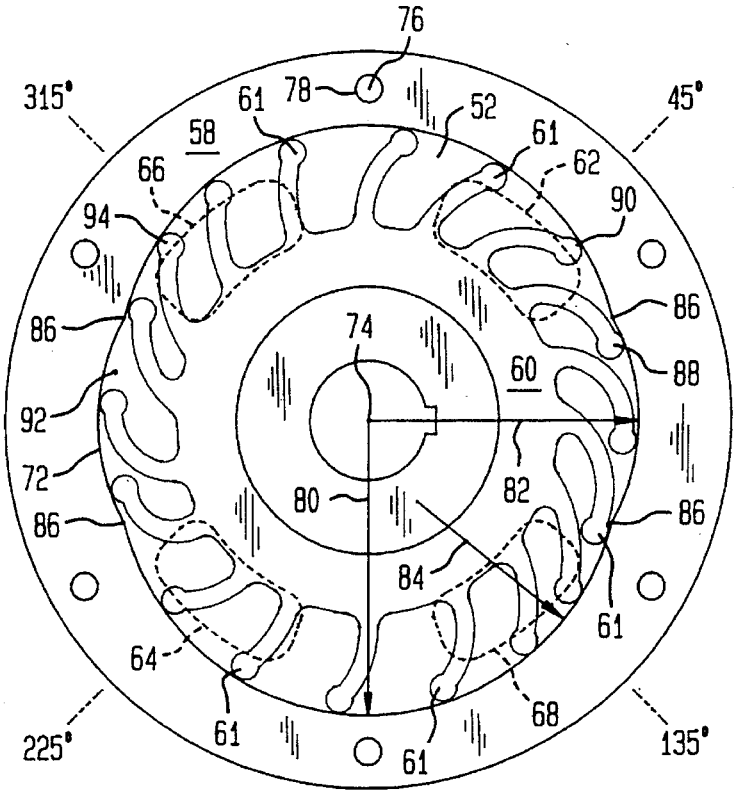
FIG. 11 is a side elevational view of the flexible-impeller pump assembly with the porting therefor shown in phantom.

The surface 72 of the ring 58 is novelly defined of a plurality of radii. A radius 80, subsisting at the top and bottom of the pump 70, and a shorter radius 82 obtaining at the opposite sides of the surface 72, are drawn from the radial center or axis 74, and a third radius 84, drawn from designated locii at four places offset from the axis or radial center (only one of which is shown) defines portions of the surface 72 which Join the surfaces formed by radii 80 and 82. Too, radii 84 define cusps 86 at four locations about the surface 72. The cusps 86 comprise means for causing the fingers or vanes 61 to flex outwardly or inwardly, abruptly, as they pass over the cusps and move onto the next-adjacent surfacing. As a consequence, the vanes or fingers 61 are given a "bump," so to speak, to enhance fluid intake and to enhance fluid discharge at these locations. With reference to FIG. 11, for instance, it can be seen that finger 88 is greatly bent and is moving upon the cusp 86 thereat, whereas finger 90 has passed the cusp 86 and has swung outwardly to define an enlarged subchamber 92 there which is open to the port 62 to draw a marked quantity of fluid thereinto. Similarly, finger 92, at the other side of the impeller 60, has moved onto the cusp 86 thereat and, as a consequence, has been bent severely causing it to expel its captured fluid into port 66 as it passed thereover; finger 94 which follows will also be forced to squeeze out its contained fluid as it moves onto the cusp 86 there.

While I have described in my invention in connection with specific embodiments of the pump 10, the impellers 32 and 60 and shaft 42 assembly, and the flexible-impeller pump assembly 70, it is to be understood that this is done only by way of example, and not as a limitation to the scope of the invention as set forth in the objects thereof and in the appended claims. The pump is illustrated and described as of the vortex type, however this is only exemplary. Too, the vanes 61 of the priming impeller 60 are stated to be rubber; clearly the same could be formed of some durable, flexible plastic, or the like. All such alternative embodiments of the invention, as will occur to others by taking teaching from my disclosure, are deemed to be within the scope of my invention and embraced by the following claims.

I claim:

1. A rotary, liquid pump, comprising:

a housing, said housing having a pair of liquid-working chambers formed therein;

a shaft journaled in said housing;

a pair of impellers mounted on said shaft, in spaced apart disposition, for rotation in common with said shaft;

means for admitting liquid into said housing; and means for discharging impelled liquid from said housing;

wherein one of said impellers has rigid vanes, said one impeller being confined within one of said chambers;

the other of said impellers has flexible vanes, said other impeller being confined within the other of said chambers; and said other chamber having an inner surface which includes cusps formed therein at a plurality of locations along said inner surface of said other chamber.

2. A rotary, liquid pump, according to claim 1, wherein:

said admitting means comprises a conduit (a) coupled to said housing, and (b) opening onto said one chamber.

3. A rotary, liquid pump, according to claim 1, wherein:

said discharging means is in communication with said chambers for discharging impelled liquid therefrom.

4. A rotary, liquid pump, according to claim 1, wherein:

said discharging means comprises a first outlet, opening onto said one chamber, for discharging impelled liquid therefrom.

5. A rotary, liquid pump, according to claim 4, wherein:

said first outlet has means cooperative with said other impeller for inducing a vacuum pressure in said admitting means.

6. A rotary, liquid pump, according to claim 1, wherein:

said other chamber has a pair of plates, fixed therein, in spaced-apart parallelism;

one of said plates comprises an outer wall of said one chamber;

said plates have apertures formed therein for accommodating a conduct of impelled liquid into and out of said other chamber; and said other impeller is interposed between said plates.

7. A rotary liquid pump, according to claim 1, wherein:

said one chamber has a given outside diameter; and said one impeller has an outer diameter of approximately half said given diameter.

8. A rotary, liquid pump, according to claim 1, wherein:

said one chamber has confronting, parallel walls; and said vanes of said one impeller are spaced apart from each of said walls not less than approximately one-eighth of an inch.

9. A rotary, liquid pump, according to claim 1, wherein:

said one impeller is a primary, liquid-working impeller; and said other impeller is a priming impeller.

10. A rotary, liquid pump, according to claim 3, wherein:

said discharging means comprises a plurality of outlet ports, formed in said other chamber, and opening onto said priming impeller.

11. A rotary, liquid pump, according to claim 6, wherein:

said one plate has a plurality of said apertures formed therein, the latter comprising inlet ports opening onto said priming impeller.

12. A rotary, liquid pump, according to claim 1, wherein:

said other chamber comprises means for accommodating an axial flow of liquid therethrough.

13. A rotary, liquid pump, according to claim 1, wherein:

said chamber is circumferentially defined by a continuous cam ring.

14. A rotary, liquid pump, according to claim 6, further including:

a continuous cam ring interposed between said plates.

15. A flexible-impeller pump assembly, comprising:

a ring, having an inner circumferential surface;

an impeller, having flexible fingers, disposed in said ring on a given axis;

walls (a) fixed to either sides of said ring, (b) cooperating with said surface to define a pumping chamber within said ring and between said walls; wherein said surface is uninterruptedly continuous;

one of said walls has inlet porting formed therein for admitting fluid, axially, into said chamber; and another of said walls has outlet porting formed therein for discharging fluid, axially, from said chamber;

wherein said surface has cusps formed therein for causing said fingers of said impeller to flex abruptly at a plurality of locations within said chamber.

16. A flexible-impeller pump assembly, according to claim 15, wherein:

each of said walls has a pair of ports formed therein.

17. A flexible-impeller pump assembly, according to claim 16, wherein:

said ports of each pair are equally spaced apart.

18. A flexible-impeller pump assembly, according to claim 16, wherein:

said ports of one pair thereof are located, relative to said axis, ninety degrees of arc from the other pair thereof.

19. A flexible-impeller pump assembly, according to claim 15, wherein:

said surface is formed of a plurality of radii.

20. A flexible-impeller pump assembly, according to claim 15, wherein:

said ring has a radial center; and said surface is formed of a plurality of radii drawn from said center, and a plurality of radii drawn from loci offset from said center.

* * * * *